US005944069A

United States Patent [19]

Nusbaumer et al.

[11] Patent Number: 5,944,069

[45] **Date of Patent: *Aug. 31, 1999**

[54] FUELING NOZZLE FOR AN AUTOMATED FUEL MANAGEMENT SYSTEM, COMPONENTS THEREFOR AND METHODS OF MAKING THE SAME

[76] Inventors: Joseph M. Nusbaumer, 1602 Oak Ridge Ct., Nixa, Mo. 65714; Ronald Woods, 5186 N. Farm Rd. 159, Springfield, Mo. 65803

[ * ] Notice: This patent is subject to a terminal disclaimer.

[21] Appl. No.: 09/037,365

[22] Filed: Mar. 10, 1998

Related U.S. Application Data

[63] Continuation of application No. 08/697,818, Aug. 30, 1996, Pat. No. 5,727,608

[60] Provisional application No. 60/018,291, May 24, 1996.

[51] Int. Cl.[6] ..... B67D 5/01

[52] U.S. Cl. ..... 141/94; 141/98; 141/231; 141/351; 705/413

[58] Field of Search ..... 141/94, 98, 231, 141/351; 705/413

[56] References Cited

U.S. PATENT DOCUMENTS

| | | | |
|---|---|---|---|
| 3,042,084 | 7/1962 | Boone et al. | 141/225 |
| 4,263,945 | 4/1981 | Van Ness | 141/98 |
| 4,441,533 | 4/1984 | Snyder et al. | 141/59 |
| 4,469,149 | 9/1984 | Walkey et al. | 141/94 |
| 4,490,798 | 12/1984 | Franks et al. | 364/550 |
| 4,834,150 | 5/1989 | Gadke et al. | 141/98 |
| 4,967,366 | 10/1990 | Kaehler | 364/479 |
| 5,156,198 | 10/1992 | Hall | 141/94 |
| 5,249,612 | 10/1993 | Parks et al. | 141/219 |
| 5,343,906 | 9/1994 | Tibbals, III | 141/83 |
| 5,359,522 | 10/1994 | Ryan | 364/465 |

*Primary Examiner*—J. Casimer Jacyna
*Attorney, Agent, or Firm*—Richard L. Marsh

[57] ABSTRACT

A fueling nozzle having a rotatable locking ring adjacent its discharge end and adapted for mating with and being secured to a fuel receiving tank adapter at a common datum line has a receiving antenna associated with the nozzle and the fuel receiving tank has a transmitting antenna associated therewith. The fueling nozzle is activated by information transmitted as a continuous radio frequency signal from a continuously operating identity transmitter mounted on a vehicle desiring fueling. The identity transmitter is powered by the vehicle power source and requires no special activation by the user. The receiving antenna comprises a circumferential band completely encircling the nozzle and is insulated therefrom and secured thereabout. The receiving antenna is in such close proximity with the transmitting antenna as to interrupt transmission of the information and to cause cessation of a fueling operation upon withdrawal of the fueling nozzle from the fuel tank by more than a maximum functional distance.

19 Claims, 6 Drawing Sheets

FUELING NOZZLE FOR AN AUTOMATED FUEL MANAGEMENT SYSTEM, COMPONENTS THEREFOR AND METHODS OF MAKING THE SAME

CROSS REFERENCE TO RELATED APPLICATION

This application is a continuation of Applicants' parent patent application Ser. No. 08/697,818 filed on Aug. 30, 1996, now U.S. Pat. No. 5,727,608. Applicants have filed herein a Terminal Disclaimer under 37 C.F.R. § 1.321(c) to disclaim the terminal part of any patent granted on this application Ser. No. 09/037,365 which would extend beyond the expiration date of U.S. Pat. No. 5,727,608.

This application is a non-provisional application under 35 U.S.C. 111 (a) of its parent provisional application Ser. No. 60/018,291, filed May 24, 1996.

BACKGROUND OF THE INVENTION

1. Field of the Invention

This invention relates to an automated fuel management control system for reliable and secure control of inventories, dispensing, usage and record keeping of fueling systems particularly for diesel powered railroad locomotives.

2. Prior Art Statement

It is known to provide a system for dispensing and controlling the transfer of liquid fuel to vehicles by the use of an identifying key or an encoded card. For instance, see the U.S. Pat. No. 4,490,798, issued to Franks, et al., on Dec. 25, 1984.

It is also known to provide a system for dispensing and controlling the transfer of liquid fuel to vehicles by electrically interconnecting the pumping unit to the vehicle. For instance, see the U.S. Pat. No. 5,343,906, issued to Harry F. Tibbals, III, on Sep. 6, 1994.

Likewise, it is known to provide a system for dispensing and controlling the transfer of liquid fuel to vehicles by utilizing a hand held transmitter to transmit the encoding information to the pumping unit. For instance, see the U.S. Pat. No. 4,834,150, issued to Gädke, et al., on May 30, 1989 and U.S. Pat. No. 4,967,366, issued to David L. Kaehler on Oct. 30, 1990.

It is further known to provide a system for dispensing liquid fuel to vehicles having a plurality of optical data readers circumferentially disposed about and carried by a dispensing nozzle and an optical data providing means comprising a plurality of optical data transmitters mounted on an inner circumferential surface of a tubular entry port wherein the optical data reader and optical data providing means are longitudinally aligned upon insertion of the dispensing nozzle into a predetermined safe fuel dispensing position within the tubular entry port. For instance, see the U.S. Pat. No. 4,469,149, issued to Walkey, et al., on Sep. 4, 1984.

Additionally, it is known to provide two way communication between a fluid delivery system and a fluid container each having an information storage and retrieval device associated therewith and having a security means for discontinuing the fluid delivery transaction if the security means does not receive a series of identification signals transmitted throughout the fluid delivery transaction wherein the identification signals are transmitted by and received by inductive coils associated with the fluid container and the fluid delivery system. For instance, see U.S. Pat. No. 5,359,522 issued on Oct. 25, 1994 to Michael C. Ryan or the U.S. Pat. No. 5,156,198 issued on Oct. 20, 1992 to Gerald L. Hall.

It is also known to provide a system for dispensing and controlling the transfer of liquid fuel to vehicles by utilizing a transmitter mounted on board the vehicle to transmit encoding information by radio frequency to the pumping unit. For instance, see U.S. Pat. No. 4,263,945, issued on Apr. 28, 1981 to Bradford O. Van Ness.

Finally, it is known to provide an apparatus for controlling the flow of fluid through an outlet by providing a sensing means adapted for placement adjacent to the outlet for detecting the presence of a fluid containing receptacle, such as the metal of a fuel tank filler neck, closer than a predetermined distance from the sensing means and having a signaling means for altering the state of a signal when the sensing means detects the receptacle and measures a predetermined response of the receptacle to a field generated by the sensing means. For instance, see U.S. Pat. No. 5,249,612, issued on Oct. 5, 1993 to Parks, et al.

Each of the above patents has an unique method of providing some measure of security to a fueling operation but each also has at least one drawback which may permit unauthorized dispensing of fuel, interrupted fueling operation, or result in unsafe fueling operation. Where an onboard transmitter, key card or a single identifying means, such as a magnet, is utilized, only general proximity of the sensor and the receiver is required which may result in unauthorized dispensing of fuel. Those systems having an inductive coil associated with the fueling nozzle require a core element of ferrous material to complete the inductive circuit which may cause sparking upon insertion of the nozzle resulting in unsafe fueling operations. Similarly, a device requiring physical electrical connection to the fueling dispenser may also result in sparking and unsafe fueling operation. Finally, the systems utilizing a plurality of transmitter/receivers arranged circumferentially about the fuel filler neck and a plurality of transmitter/receivers arranged circumferentially about the nozzle may result in interrupted fueling operations upon loss or failure of a single transmitter/receiver.

Therefore, it is an object of this invention to provide an automated fueling facility comprising a fuel receiving station, at least one fuel storage tank, at least one fuel dispensing station all these components connected by associated transfer piping and a central data collection station, wherein each of the components has means for communicating with the central data collection station. The central data collection station further has means for receiving information which is transmitted from a vehicle desiring fueling, comparing the information to selected stored information, authorizing properly coded vehicles access to fuel from the fuel dispensing station and ceasing fueling operations at the fuel dispensing station when the transmitted information is interrupted. The improved fuel dispensing station has a fuel dispensing nozzle adapted for mating with and being secured to a fuel receiving tank at a common datum line, wherein the nozzle has a receiving antenna associated therewith and the fuel receiving tank may have a transmitting antenna associated therewith. The transmitting antenna transmits a radio frequency signal having encoded information about the vehicle. The receiving antenna and transmitting antenna, where installed in the adaptor to the fueling tank, are is such close proximity as to interrupt transmission of the information and to cause cessation of the fueling operation upon minimal withdrawal of the fueling nozzle from the fuel tank.

It is another object of this invention to provide a fueling dispenser having means for communicating with a central data collection station of a fueling facility wherein the central data collection station has means for receiving information transmitted from at least one vehicle desiring fueling, comparing the information to selected stored information, authorizing properly coded vehicles access to fuel from the fuel dispenser and ceasing fueling operations at the fuel dispenser when the transmitted information is interrupted. The improved fuel dispenser has a fuel dispensing nozzle adapted for mating with and being secured to a fuel receiving tank at a common datum line. The nozzle has a receiving antenna associated therewith and the fuel receiving tank may also have a transmitting antenna associated therewith. The transmitted information is transmitted as a continuous radio frequency signal. The receiving antenna and the transmitting antenna, where installed in the adaptor to the fuel receiving tank, are is such close proximity as to interrupt transmission of the transmitted information causing cessation of the fueling operation upon minimal withdrawal of the nozzle from the fuel tank.

It is yet another object of this invention to provide a fueling nozzle adapted for mating with and being secured to a fuel receiving tank at a common datum line, wherein the nozzle has a receiving antenna associated therewith and the fuel receiving tank has a transmitting antenna associated therewith and wherein the transmitting antenna transmits information as a continuous radio frequency signal. The improved nozzle has its associated receiving antenna in such close proximity to the transmitting antenna when the fueling nozzle is fully inserted into the fuel receiving tank to interrupt the transmission of the information and to cause cessation of said fueling operation upon minimal withdrawal of the fueling nozzle from the fuel tank.

It is another object of this invention to provide means to interrupt the flow of fuel in a fueling operation upon minimal withdrawal of the fueling nozzle to prevent fuel spillage.

It is another object of this invention to provide means to interrupt the flow of fuel in a fueling operation when a line of sight between the transmitting antenna and the receiving antenna is broken.

It is another object of this invention to provide means to interrupt the transmission of a radio frequency signal when the nozzle is withdrawn more than seven eighths of an inch from full mating engagement with the fuel receiving tank or when the transmitting antenna is withdrawn more than seven eighths of an inch from engagement with a mounting means associated with the fuel receiving tank.

It is a further object of this invention to provide a receiving antenna circumferentially disposed about the discharge end of a fueling nozzle thereby allowing receipt of the radio frequency signal at any circumferential engagement of the nozzle within an adaptor attached to a fuel receiving tank.

It is also an object of this invention to provide a receiving antenna circumferentially disposed about the discharge end of the fueling nozzle at a predetermined distance from a datum line common with a fuel receiving tank as a continuous circumferential band of metallic material secured about and insulated from the nozzle and having an antenna lead attached thereto which is shielded from electrical and radio frequency interference and protected from the fuel being transferred.

It is yet a further object of this invention to provide a transmitting antenna mounted in only one location within a portion of the fuel receiving tank at a predetermined distance from the datum line wherein the transmitting antenna comprises a flat disc of metallic material disposed in one end thereof.

Finally, it is an object of this invention to provide a transmitting antenna and a receiving antenna wherein the transmitting antenna has means for transmitting certain fixed and/or variable data information relating to the receiving vehicle and the receiving antenna has means for receiving the certain fixed and/or variable data and transmitting same to a central data receiving station.

SUMMARY OF THE INVENTION

Presently, automated vehicle fueling systems utilize either a keypad for entry of vehicle data and fuel desired, a coded card with the vehicle data stored thereon or a low frequency, low power level transmitter which transmits a continuous data bit stream with coded vehicle data through the atmosphere between the vehicle and a remote receiver. None of these systems has sufficient security to prevent fueling of unauthorized vehicles or containers when an authorized user is in the vicinity. In the keypad entry system, fueling would continue as long as no interrupting operation was entered on the keypad. Similarly, an authorized coded card could be inserted into the receiving unit and numerous vehicles or containers fueled as long as the coded card remained in the receiving unit or until the fueling event was terminated. Furthermore, even though the low frequency, low power transmitter has a limited range, nothing prevents the operator from withdrawing the fueling nozzle from an authorized vehicle tank and placing the nozzle in an unauthorized vehicle tank or container as long as the receiver remains in the vicinity of the non-directional transmitter. Additionally, since the gain of the amplifier in the receiver is modulated by electronic circuitry within the receiver to compensate for the varying distances between the transmitter and the receiver, this distance from the transmitter and receiver and, hence, the distance from the vehicle to the nozzle, could be varied by the operator during an authorized fueling operation with the full cooperation of the electronic receiver. The onboard low frequency, low power transmitter still has significant advantages over the keypad entry or coded card systems yet requires a greater measure of security to ensure that absolutely no unauthorized fueling operations can occur.

The fuel management system of this invention provides for secure fueling operations through transmission and receipt of an authorizing digital data string by placing the receiving and transmitting antennae in such close proximity as to prevent unauthorized fueling. Automated recording of fuel received or dispensed, the identity of the receiving or dispensing company, the identity of the receiving or dispensing vehicle and the temperature of the fuel being received or dispensed may also be accomplished by this improved system. Further information available from the fuel management system includes the date and time of each transaction, the facility location of the transaction and the identifying number of the specific unloading or fueling station for easy identification of system problems from a central facility terminal or a remote monitoring terminal. All or selected information available from a fueling facility may be made available to the receiving or dispensing company at time intervals desired by the respective company through the use of the central control unit computer, modem and printer. Furthermore, instant receipts may be generated for the convenience of the operator of the receiving or dispensing vehicle.

DESCRIPTION OF THE PREFERRED EMBODIMENTS

Figure 1:
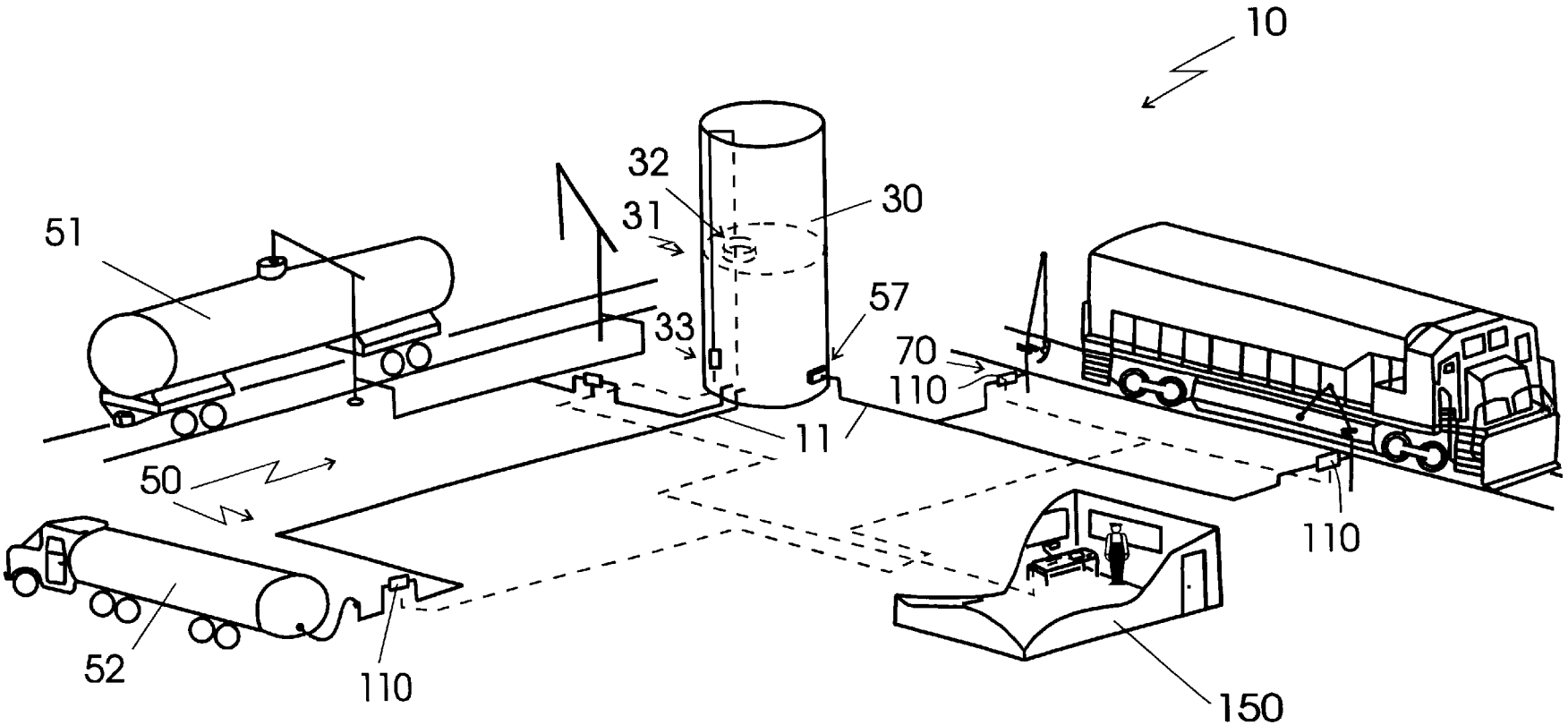
FIG. 1 is a perspective view of a fueling facility layout containing the fuel management control system of this invention.

While the various features of this invention are hereinafter described and illustrated as particularly adapted to provide a fuel management system including a means for secure fueling of railroad locomotives, it is to be understood that the various features of this invention can be utilized singly or in various combinations thereof to provide for the secure management of the transfer of other fluids for other purposes.

Therefore, this invention is not to be limited to only the embodiments illustrated in the drawings, because the drawings are merely utilized to illustrate some of the wide variety of uses of this invention as hereinafter described.

Figure 5:
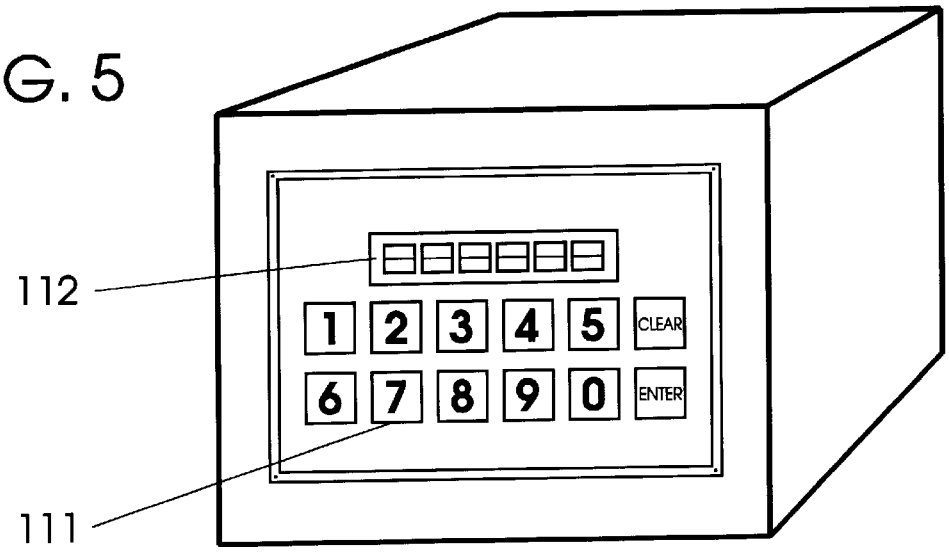
FIG. 5 is a perspective view of an interface terminal unit utilized at the fuel unloading station of FIG. 2 and the locomotive fueling station of FIG. 5.

Referring now to FIG. 1, a fueling facility for railroad locomotives, generally depicted by the numeral 10, comprises fuel unloading stations 50 for either rail car 51 or truck transport 52, at least one fuel storage tank 30, at least one locomotive fueling station 70, a central data collection and dissemination terminal 150 and associated connective piping 11 for transferring fuel from a fuel unloading station 50 to a storage tank 30 and from a fuel storage tank 30 to a locomotive fueling station 70. An interface terminal 110, shown in FIG. 5, is located adjacent to each of fuel unloading stations 50 and each of fueling stations 70 for receipt, processing and transfer of transaction information associated with the activity at that interface terminal 110 as hereinafter described. Each interface terminal 110, as shown in FIG. 5, is directly wired to central data terminal 150 and is equipped with a numerical key pad 111 for manual input of information and an LCD (liquid crystal display) 112 for interactive prompting and displaying of authorizing information.

Figure 2:
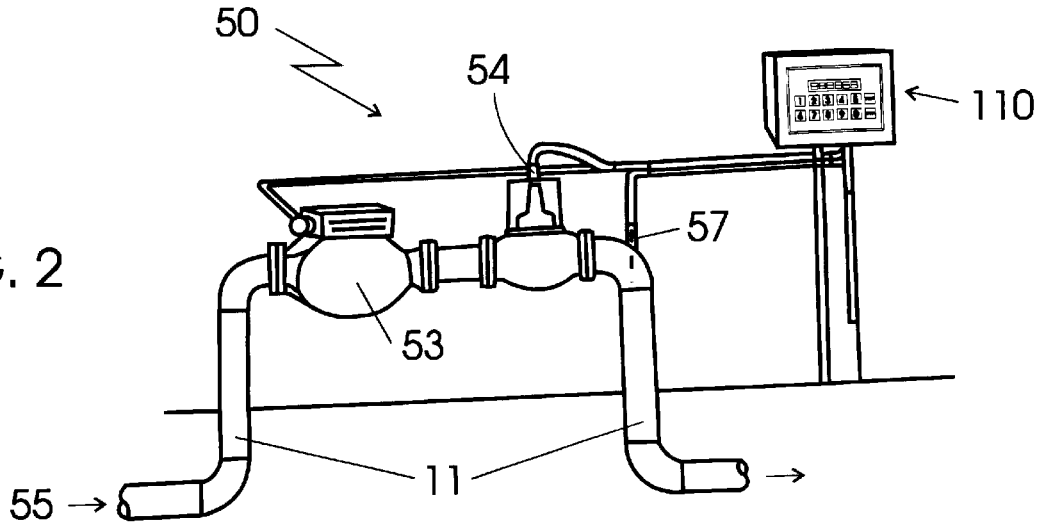
FIG. 2 is a perspective view of the fuel unloading station of the fueling facility of FIG. 1.

Referring now to FIG. 2, each fuel unloading station 50 has a meter 53, a solenoid valve 54 and a temperature probe 57 all disposed in connective piping 11 between connection point 55 and fuel storage tank 30. A representative of a dispensing company which is a supplier of fuel for the facility enters company identification information, vehicle number, personal identification code and invoice number into interface terminal 110. Interface terminal 110 compares the entered information with authorized information stored therein and when properly compared, transmits an electrical signal to solenoid valve 54 allowing fuel to pass through meter 53 from the associated connection point 55 to the storage tank 30. Upon completion of the unloading operation, interface terminal 110 transmits the entered identifying information, time, date, temperature of the fuel and exact amount of fuel received to central data terminal 150.

Figure 4:
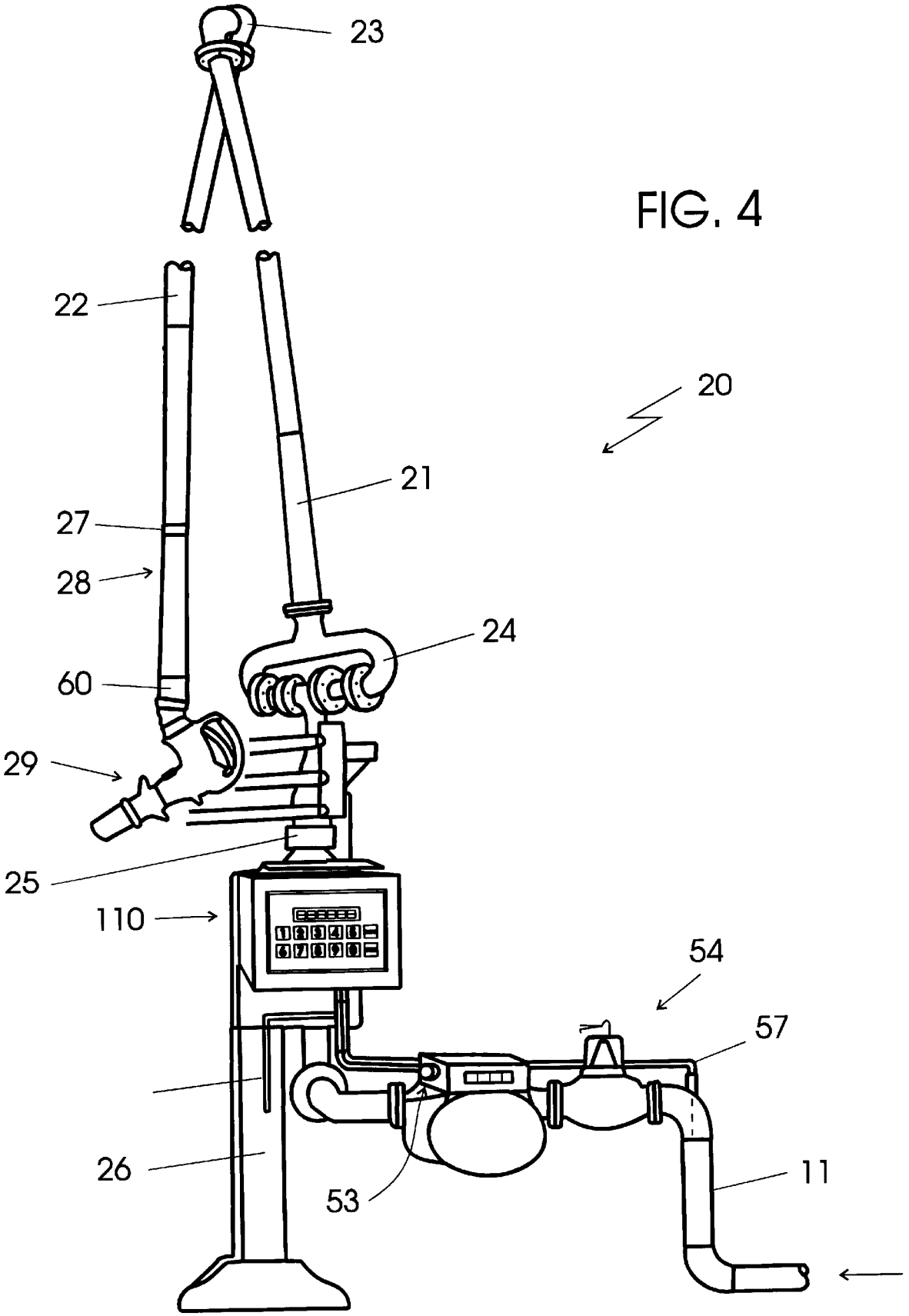
FIG. 4 is a perspective view of a locomotive fueling station of the fueling facility of FIG. 1 having an improved fueling nozzle of this invention attached to a fueling crane boom.

Similarly, as shown in FIG. 4, each fueling station 70 has a meter 53, a solenoid valve 54 and a temperature probe 57 all disposed in connective piping 11 between storage tank 30 and fuel crane 20. A locomotive desiring fuel from the facility may enter railroad identification information, locomotive number and personal identification code into interface terminal 110, however, automatic identification from the locomotive is also possible through the novel transmitting and receiving device of this invention as hereinafter described. In either case, interface terminal 110 compares the information with authorized information stored therein and when properly compared, transmits an electrical signal to solenoid valve 54 allowing fuel to pass through meter 53 from storage tank 30 to fueling crane 20. Upon completion of the fueling operation, interface terminal 110 transmits the identifying information, time, date, temperature of the fuel and exact amount of fuel dispensed to central data terminal 150.

Fuel storage tanks 30 of FIG. 1, are equipped with temperature probes 57 and a tank level indicator 31 comprising a float 32 and gauge head transmitter 33 for continuously monitoring the amount of fuel contained in tank 30. Gauge head transmitter 33 and temperature probe 57 are directly wired to an interface terminal 10 for determination of tank information by central data terminal 150. The fuel temperature is measured at each transfer point in the fueling facility 10 by temperature probes 57 in order to calculate a net amount of fuel transferred during each fueling transaction at a constant reference temperature of sixty degrees Fahrenheit, 60° F.

Central data terminal 150 receives information from each of the interface terminals 110 throughout the entire fueling facility 10 and stores this information in digital format in a stand alone computer (not shown). The data collection program onboard the computer is programmed to group the data received into the various formats best utilized by the respective operating, transportation, purchasing, maintenance and accounting departments of the railroads utilizing the fueling facility. Although the fuel management control system is fully automated through the interactive interface terminals 110, the current period transactions are displayed in columnar format on the monitoring screen (not shown) for instant review by the central data terminal operator. Any, or all, transactions may be provided in hardcopy format utilizing an attached printer (not shown). Furthermore, since each unloading station 50, each fueling station 70 and each fueling crane 20 of each fueling facility 10 has an unique identifying number associated there with, central data terminal 150 and/or remote monitoring terminal each is able to immediately identify a component of the fuel management system which may be causing fueling problems and render inoperable any of the aforementioned components until repairs may be effected.

Figure 6:
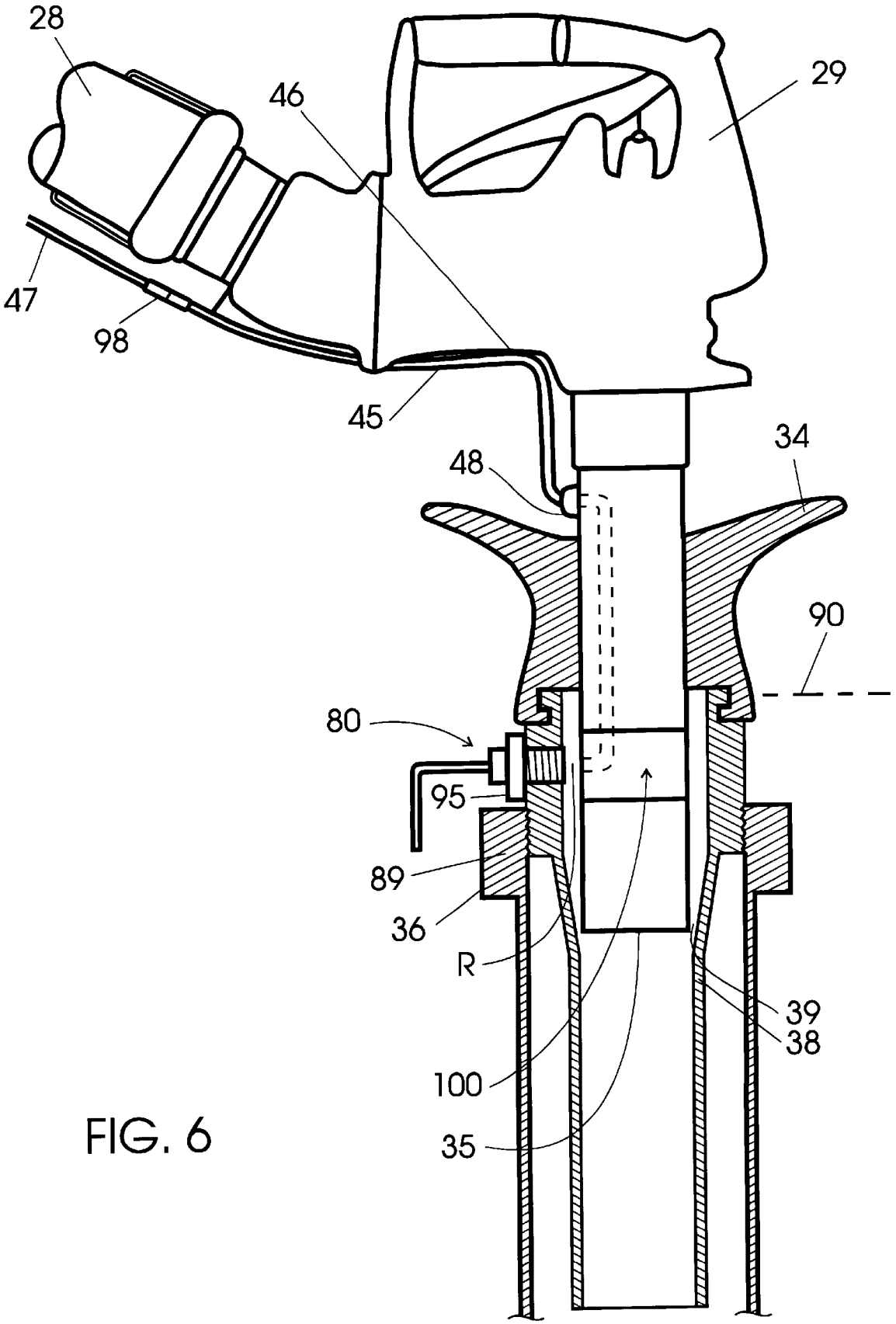
FIG. 6 is a partially cut away portion of the fueling nozzle and tank adaptor of this invention containing the transmitting antenna and signal receiver of this invention.

Referring again to FIG. 4, each fueling crane 20 has an articulated boom comprising two substantially equal lengths of piping joined together with a swivel joint 23 at their common ends while the opposite end of one pipe 21 further has a "D" shaped horizontal swivel joint 24 attached to a vertically disposed swivel joint 25 mounted atop a pedestal 26. Each swivel joint has a fluid passage therein for the passage of fuel from connective piping 11 to outer end 27 of other pipe 22. Outer end 27 of other pipe 22 is fitted with a short length of flexible fuel transfer hose 28 having a fueling nozzle 29 attached to its terminal end. As best seen in FIG. 6, fuel nozzle 29 has a rotatable locking ring 34 adjacent its discharge end 35 adapted for mating with a fuel tank adapter 36 on a locomotive fuel tank. Fuel tank adapter 36 and discharge end 35 of fuel nozzle 29 cooperate to form a vacuum chamber 39 therebetween for developing a vacuum to operate an automated shutoff valve in nozzle 29 when the air pressure through a vent tube attached to the tank reduces as is fully described in U.S. Pat. No. 4,441,533, issued to Snyder, et al., on Apr. 10, 1984 and incorporated into this patent by this reference thereto.

Figure 3:
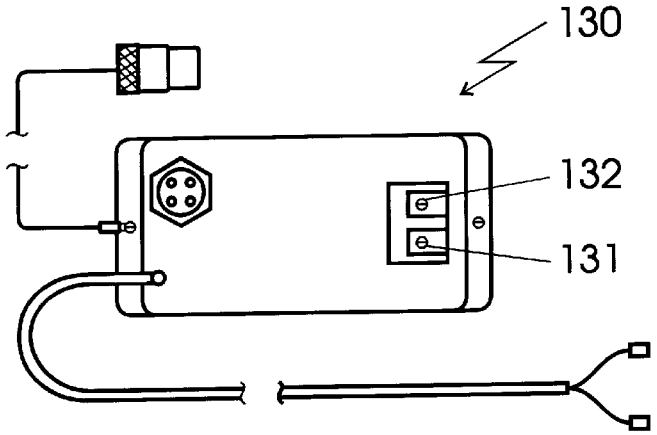
FIG. 3 is a plan view of a programmable locomotive identity transmitter utilized with the fuel management control system of this invention.

An integral part of the automated fuel management control system of this invention is a locomotive identity transmitter 130, of FIG. 3, mounted on each locomotive which continuously transmits a digital data string of identifying information about the locomotive, such as locomotive number, railroad AAR identification initials and tank capacity. Transmitter 130 may further transmit other pertinent data about the vehicle as is fully described in U.S. Pat. No. 4,263,945, issued on Apr. 28, 1981, to Bradford Van Ness, and is incorporated into this specification by this reference thereto. For instance, the fuel tanks of each locomotive may be fitted with a level indicator of the type and character utilized in the fuel storage tanks 30, or another suitable device, which is attached to transmitter 130 for continuously monitoring the level of fuel in the tank and converting this information to a digital signal for transmission to the fueling facility 10 during the fueling operation. In this manner, the fuel requirements of the locomotive may be automatically satisfied by the interactive nature of the fuel management control system. Presently, fixed identifying information is pre-programmed into locomotive identity transmitter 130 and is unique to the particular locomotive on which transmitter 130 is mounted. Locomotive identity transmitters may be recycled from one locomotive to another, however, once removed from one locomotive 130 and reinstalled upon another locomotive, identity transmitter 130 must be re-programmed for the particular identity of the new locomotive.

The fuel dispensing control system as described in the aforementioned U.S. Pat. No. 4,263,945 has been extensively utilized in locomotive fueling facilities and relies upon the continuous transmission of the digital data string through the atmosphere from the onboard transmitter 130 to a receiving antenna mounted on or near the fueling nozzle 29. Although the receiving unit of the aforementioned U.S. Pat. No. 4,263,945, is equipped with an automatic gain amplifier to compensate for the varying distance between the transmitter 130 and the receiving antenna and a spike filter to filter out impulse noise RF, or radio frequency, interference is still present and security of the fueling facility may still be breached as the distance between the antenna and the transmitter does not prevent fueling of an adjacent vehicle or storage container prior to, or subsequent to, fueling of the authorized vehicle. Furthermore, since the receiver need only be in the vicinity of the transmitter, information from the transmitter may be received by a receiver somewhat remote from the transmitter. In fact, it was found that simultaneous fueling of two locomotives joined in tandem from two separate fueling stations 70 often resulted in crosstalking between the receiving units resulting in an interruption of the fueling operation of one or the other of fueling stations 70, or the recording of incorrect information from one or the other of fueling stations 70.

Figure 7:
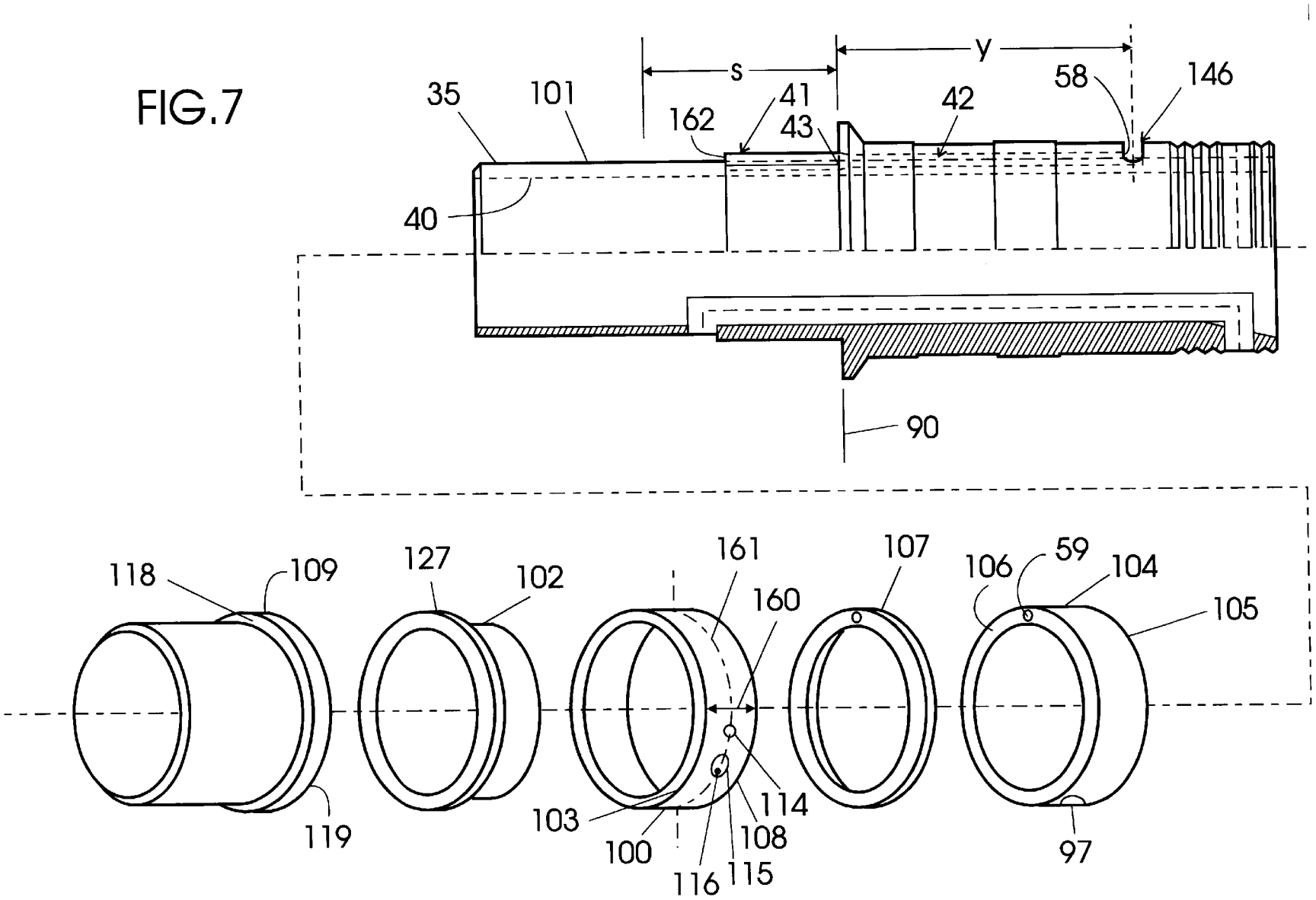
FIG. 7 is an exploded view of the receiving antenna and fueling spout of this invention.
Figure 8:
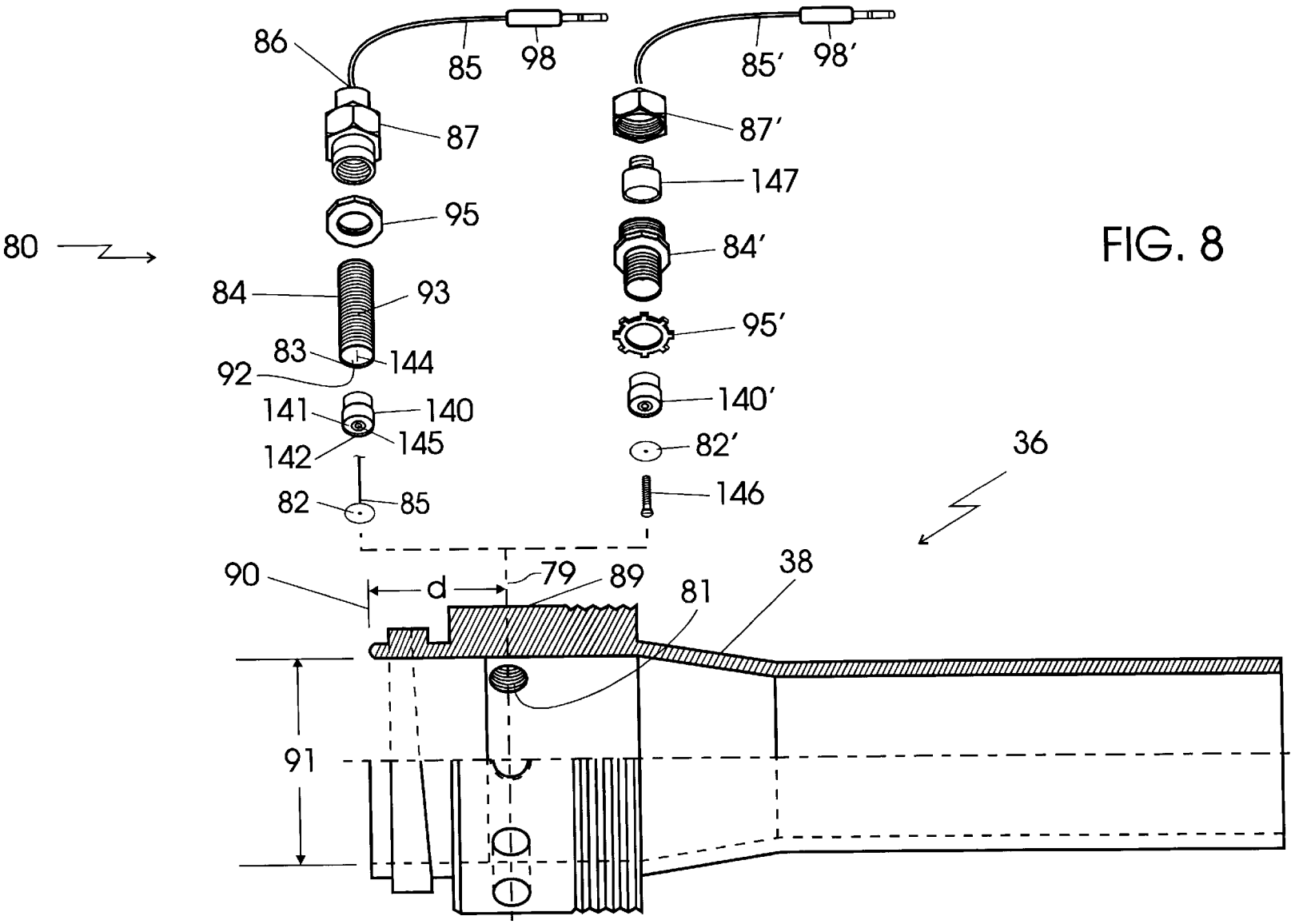
FIG. 8 is an exploded view of a transmitting antenna and fuel tank adaptor of this invention.

Referring now to FIGS. 6, 7 and 8, the novel features of this invention will become readily apparent from the following description. In the aforementioned U.S. Pat. No. 4,441,533, when fueling nozzle 29 is telescopically inserted into fuel tank adaptor 36 and positively affixed thereto with locking ring 34, a vacuum chamber 39 is created between the discharge end 35 of fueling nozzle 29 and a frustoconical terminal end section 38 of fuel tank adaptor 36. The vacuum created in the chamber 39 by the flow of fuel through nozzle 29 is utilized to operate the automatic shutoff feature of nozzle 29 having a pressure balance diaphragm as an integral part of the operating mechanism. Thus, discharge end 35 of fueling nozzle 29 is tubular and extends into fuel tank adaptor 36 by approximately five inches, terminating just short of frustoconical terminal end section 38. In the instant invention, the relationship between the discharge end 35 of fueling nozzle 29 and frustoconical terminal end section 38 of fuel tank adaptor 36 is substantially unchanged from the aforementioned U.S. Pat. No. 4,441,533.

Still referring to FIGS. 6, 7 and 8 discharge end 35 of fueling nozzle 29 is adapted to slide freely within inner bore 91 of fuel tank adaptor 36 to allow fuel to pass therethrough into an attached fuel tank on the locomotive. Fueling nozzle 29 is releasably attached to fuel tank adaptor 36 by a rotatable locking ring 34, mating fueling nozzle 29 and fuel tank adaptor 36 together along a common plane, datum line 90. A receiving antenna 100 is located on discharge end 35 of fueling nozzle 29 outwardly of datum line 90 toward discharge end 35 and is spaced from datum line a distance "S". Receiving antenna 100 has a width 160 between an outboard edge 103 and an inboard edge 108 with a centerline 161 disposed equidistant from outboard edge 103 and inboard edge 108. Distance "S" is measured from datum line 90 to centerline 161.

Similarly, as is best observed in FIG. 8, a transmitting antenna 80 is located in a flange 89 of fueling tank adaptor 36 inwardly of datum line 90 toward frustoconical terminal end section 38 and is spaced from datum line 90 a distance "d". Transmitting antenna 80 has a tubular member 84 having a center line 144. Distance "d" is measured from datum line 90 to center line 144. Transmitting antenna 80 may, of course, be another shape yet having a center 144 at a distance "d" from datum line 90. When fueling nozzle 29 is inserted into fueling adaptor 35, receiving antenna 100 substantially aligns with transmitting antenna 80 as distance "S" is substantially equal to distance "d" as will become readily apparent in the following operational description.

Receiving antenna 100 is disposed upon the outer periphery 101 of the discharge end 35 and insulated therefrom by suitable insulating sleeve 102 and insulating washer 107. Receiving antenna 100 is generally a broad band of stainless steel while insulating sleeve 102 is a broader band of a generally elastomeric material each band completely encircling outer periphery 101 of discharge end 35. Of course, receiving antenna 100 may consist of multiple turns of fine wire wound tightly around discharge end 35 and contained within the edges of insulating sleeve 102 with at least one of the ends of the fine wire attached to an end of an antenna wire 42.

In order to protect an antenna lead 47 from the fuel being dispensed, an elongated antenna connection conduit 41 has a first end 43 engaged in a hole 58 drilled longitudinally through the wall of discharge end 35. Hole 58 intersects a one-fourth inch wide ball groove 146 machined into the outer periphery 101 of discharge end 35 at a distance "Y" upstream from datum line 90 such that it does not interfere with the engagement of locking ring 34 and can be easily attached to an antenna lead 47 from interface unit 110. The other end 44 of antenna connection conduit 41 is engaged in a hole 59 drilled longitudinally through a first ring 104, first ring 104 being spaced downstream from datum line 90 at a specified distance to allow receiving antenna 100 to be aligned with transmitting antenna 80. Antenna connection conduit 41 is preferably tubular, approximately three sixteenths inch in internal diameter and formed from stainless steel, aluminum, or copper. When first end 43 is engaged in hole 58, first end 43 is sealingly affixed to hole 58 by internally expanding first end 43 into engagement with hole 58. First end 43 may also be welded, glued, upset or peened over to accomplish sealing engagement with hole 58. Similarly, other end 44 is sealingly engaged in hole 59.

Where antenna wire 42 is routed through the inner bore of flexible hose 28, each coupling end 60 of flexible hose 28 has a port (not shown) disposed through a non-rotating portion of coupling end 60 wherein antenna wire 42 is routed through a sheath sealingly attached to each port. The sheath is preferably made of an elastomeric material resistant to the fuel being transferred through flexible hose 28. Antenna wire 42 may be further enclosed in another conduit 45 routed along and rigidly affixed to a protected outer surface 46 of nozzle 29 attaching then to an antenna lead 47 made a part of flexible hose 28.

In the preferred embodiment, one end of an antenna wire 42 is affixed to receiving antenna 100 while the other end is electrically connected to interface terminal 110. In order to shield the radio frequency signal from stray RF signals, a ground is accomplished by contact of the metal parts of fueling nozzle 29 and fueling adaptor 36. Thus, the ground conductor of antenna wire 47 may be attached to fueling nozzle 29 at any location along another antenna connection conduit 45 but generally is connected to the RCA plug connection 98 at the juncture of fuel transfer hose 28 and fueling nozzle 29.

Transmitting antenna 80 is threadingly engaged in a threaded bore 81 through flange 89 of fuel tank adaptor 36. Transmitting antenna 80 comprises a disc 82 disposed in a recess 141 of an insulating plug 140 which is press fitted into an internal cylindrical portion 92 of member 84. The outer edge 142 of insulating plug 140 is flush with end 83 of tubular member 84. Disc 82 and attached antenna lead 85 are encapsulated in electrical potting compound (not shown) which extends through a central bore 145 in insulating plug 140 surrounding antenna lead 85, filling the remainder of tubular member 84, extending through hole 86 surrounding antenna lead 85 in tightening nut 87 on the end opposite end 83. One end of one conductor of transmitting antenna lead 85 is attached to disc 82 while the other end is attached to one terminal 132 on an onboard locomotive information transmitter 130 of the type described in the aforementioned U.S. Pat. No. 4,263,945. In the preferred embodiment, antenna lead 85 comprises a shielded cable wherein the central core wire is utilized as the transmitting lead and the shield is used as the shielding conductor. In order to shield the antenna, one end of a shielding conductor is attached to hollow tubular member 84 while the other end of the shielding conductor is attached to a ground terminal 131 on onboard locomotive transmitter 130.

As is best observed in FIG. 6, hollow tubular member 84 is threaded into bore 81 only to a depth such that end 83 is just flush with inner bore 91 of fuel tank adaptor 36 and is secured to flange 89 by mounting nut 95 disposed upon the threaded exterior 93 of member 84. In this manner, damage to tubular member 84 and disc 82 is prevented during the insertion of discharge end 35 of fuel nozzle 29. Tubular member 84 may substantially fill threaded bore 81 or may have a clearance surrounding its end 83. The exterior 93 of cylindrical portion 84 may be threaded the entire length.

As can readily be seen in FIG. 6, when fueling nozzle 29 is fully inserted into fuel tank adaptor 36, transmitting antenna 80 and receiving antenna 100 are longitudinally displaced a substantially equal amount from datum line 90 as previously described such that transmission of the data string from onboard locomotive transmitter 130 can proceed. Since onboard locomotive transmitter 130 constantly transmits the data string, a fueling operation may begin upon authorization by interface terminal 110. When fueling nozzle 29 is withdrawn from full engagement with fueling adaptor 36 more than a maximum functional distance, transmission of the data string ceases and interface unit 110 on fueling crane 20 interrupts the flow of fuel to fueling nozzle 29 by closing valve 54. In this manner, fuel may only be delivered to a fuel tank previously authorized in the data string transmitted from onboard locomotive transmitter 130 and unauthorized fueling of is prevented. Also, as can be seen in FIG. 6, the end 83 of tubular member 84 containing disc 82 is spaced from receiving antenna 100 by a radial distance "R" in order to prevent the crosstalking prevalent in previous systems. Furthermore, distance R provides yet another measure of security to prevent unauthorized fueling operations as distance R is less than the maximum functional distance thereby permitting and continuing the transmission of the data string. In fact, it has been found by the teachings of this invention that the maximum functional distance corresponds to a longitudinal distance of less than seven eighths inch and distance R should be less than about one-quarter inch to prevent any crosstalking from any other transmitter.

Each interface terminal 110 at each fueling station 70 is internally adjusted at installation to receive a transmitted signal of 1.5 volts peak to peak across a gap of less than one-quarter inch, and more particularly, approximately 0.100 inch, which generally corresponds to distance R between transmitting antenna 80 and receiving antenna 100. By adjusting interface terminal 110 to receive a signal across a gap of less than one-quarter inch, the combination of transmitting antenna 80 and receiving antenna 100 constitutes a substantially directional radio frequency system. Since the combination of antennae is substantially directional, a line of sight transmission is essentially established thus eliminating any possibility of cross talking with other transmitting or receiving antennae.

In order to establish the maximum functional distance, it was necessary to make the diameter of end 83 of tubular member 84 approximately three-quarters inch and disc 82 approximately 0.650 inch in diameter. Additionally, receiving antenna 100 is approximately eleven-sixteenths inch in width and, as previously noted, is essentially centered upon end 83 of tubular member 84 wherein center 144 is substantially located over centerline 161. When fueling nozzle 29 is withdrawn by a distance of approximately one half inch, the outboard edge 103 of receiving antenna 100 approaches center 144 of tubular member 84 and the strength of the received signal is significantly reduced. When fueling nozzle 29 is further withdrawn to approximately seven eighths inch from full engagement, the outboard edge 103 of receiving antenna 100 is nearing the outer diameter of end 83 of tubular member 84 and the strength of the received signal is reduced to zero. Thus, the maximum functional distance is established at approximately seven eighths of an inch. Since the signal being received by the receiving antenna 100 is no longer modulated to compensate for varying distances between transmitting antenna 80 and receiving antenna 100, interface terminal 110 loses the authorizing data stream and ceases the fueling operation.

Upon cessation of the fueling operation by loss of the authorizing data stream, fueling nozzle 29 is still engaged within fuel tank adaptor 36 by more than four inches which prevents both spillage and unauthorized fueling.

A second measure of security is provided by tubular member 84, transmitting antenna 80 and the maximum functional distance as tubular member 84 is disposed into flange 89 at least seven eighths inch thereby preventing removal of tubular member 84 during a fueling operation without interrupting the fueling operation. Since it would be possible to remove a transmitting antenna such as transmitting antenna 80 and place same alongside or touching fueling nozzle 29 after withdrawing fueling nozzle 29 from fuel tank adaptor, for the purpose of fueling an unauthorized containers such operation would be prevented with the combination of the present invention as an authorized fueling operation would cease upon exceeding the functional distance. Furthermore, it was found that when loss of line of sight between transmitting antenna 80 and receiving antenna 100 is broken, fueling operations were automatically terminated by the fuel management system of this invention.

Security of fueling operations is thus greatly enhanced utilizing transmitting antenna 80 in the novel spatial relationship to receiving antenna 100. Thus, transmitting antenna 80 cooperates with receiving antenna 100 to authorize fueling operations upon transmission of the proper data string from onboard locomotive transmitter 130 and prevents unauthorized fueling operations by interrupting the flow of transmitted data upon a minimum longitudinal withdrawl of fueling nozzle by more than the functional distance, loss of ground connection or upon loss of line of sight between transmitting antenna 80 and receiving antenna 100.

In order to construct the novel fuel management control system of this invention, the nozzle described in aforementioned U.S. Pat. No. 4,441,533 is modified in the following manner. First, antenna connection conduit 41 is formed into an elongated tube having its first end 43 engaged in a hole 58 drilled longitudinally through the wall of discharge end 35 and intersecting a one-fourth inch wide ball groove 146 machined into the outer periphery 101 of discharge end 35. Hole 58 extends a distance "Y" upstream from datum line 90 such that it does not interfere with the engagement of locking ring 34 and can be easily attached to an antenna lead 47 from interface unit 110. The other end 44 of antenna connection conduit 41 is engaged in a hole 59 drilled longitudinally through a first ring 104, first ring 104 being spaced downstream from datum line 90 at a specified distance to allow receiving antenna 100 to be aligned with transmitting antenna 80. Antenna connection conduit 41 is preferably tubular, approximately three sixteenths inch in internal diameter and formed from stainless steel, aluminum, or copper. When first end 43 is engaged in hole 58, first end 43 is sealingly affixed to hole 58 by internally expanding first end 43 into engagement with hole 58. First end 43 may also be welded, glued, upset or peened over to accomplish sealing engagement with hole 58. Similarly, other end 44 is sealingly engaged in hole 59.

Second, discharge end 35 is fitted with first ring 104 which has an upstream edge 105 and a flush square edge 106. First ring 104 also has a hole 97 for actuation of the vacuum responsive valve of the aforementioned U.S. Pat. No. 4,441,533 and is press fitted upon outer periphery 101 of discharge end 35 with upstream edge 105 facing upstream toward datum line 90 and abutting a square shoulder 162 machined onto outer periphery 101 of discharge end 35. A square edge 106 opposite upstream edge 105 of first ring 104 is spaced from datum line 90 by a distance equal to distance "S" less the sum of one half the width 160 of receiving antenna 100 and the width of an insulating washer 107. Insulating washer 107 is an upright washer of insulating material and is press fitted onto discharge end 35 abutting square edge 106. An annular insulating sleeve 102 is shaped in cross section as an elongated "L" with an insulating flange 127 integral therewith and comprising the upright leg of the "L". Insulating sleeve 102 has an overall width equal to the width of receiving antenna 100 plus the width of insulating flange 127.

Alternately, insulating sleeve 102 may comprise two pieces, each piece having an overall width of one half the width of receiving antenna 100 plus the width of an integral insulating flange 127. Two pieces of insulating sleeve 102 are then utilized to insulate antenna 100 from discharge end 35. Insulating washer 107 would be replaced by the integral flange 127 of one piece of insulating sleeve 102.

Insulating sleeve 102 and insulating washer 107 are preferably formed from an electrically insulating material such as polytetrafluoroethylene, polypropylene, polyethylene, polyamide, polyparabenzamide, silicone, viton, chloroprene, ethylene propylene polymer, isoprene, butyl, polystyrene or combinations thereof and may be compression molded, injection molded or machined from tubular material.

Receiving antenna 100 is formed into a ring approximately eleven sixteenths inch wide from tubular material, preferably stainless steel, and has one one eighth inch hole 114 drilled through the ring equidistant from each edge at centerline 161. Adjacent to hole 114, and preferably on centerline 161 is a machined recess 115 with a threaded screw hole 116 in the center thereof adapted to receive one conductor of antenna wire 42 for attachment thereto.

In the preferred embodiment, insulating washer 107 is then press fitted upon outer periphery 101 of discharge end 35 abutting square edge 106 of first ring 104. Upon seating of insulating washer 107, receiving antenna 100 is press fitted upon insulating sleeve 102 abutting the outboard edge 103 against integral insulating flange 127 and this subassembly is press fitted upon the outer periphery 101 of discharge end 35 abutting inboard edge 108 of receiving antenna 100 against insulating washer 107. Antenna lead 47 is then threaded through antenna conduit 41 from ball groove 146, under or through insulating washer 107 and in a shallow groove provided in insulating sleeve 102. The end of antenna lead 47 is then threaded through hole 114 and attached thereto with a screw placed in screw hole 116. Alternately, antenna lead 47 may be attached to receiving antenna 100 by welding or soldering same to edge 108 or to machined recess 115. Upon securing antenna lead 47 to receiving antenna 100, machined recess 115 is filled with an electrical potting compound thereby insulating and protecting antenna lead 47 from the fuel being transferred.

Finally, second ring 109 is press fitted upon outer periphery 101 with its tapered edge 118 facing away from datum line 90 and having its perpendicular edge 119 abutting integral insulating flange 127 of insulating sleeve 102. Since both rings 104 and 109 are press fitted along outer periphery 101 of discharge end 35, the location of receiving antenna 100 is fixed at the precise distance S from datum line 90.

Alternately, an assembly of receiving antenna 100 may be made by fitting receiving antenna 100 upon the two separate alternative halves of insulating sleeve 102 and abutting the two separate rings 104 and 109 against flanges 127 and press fitting the entire assembly upon discharge end 35. Similarly, since insulating sleeve 102 is an elastomeric material, it may be made in one solid piece and snap fitted within receiving antenna 100 for installation upon discharge end 35 as an assembly after press fitting of first ring 104.

Finally, fueling nozzle 29 has antenna lead 47 mounted in a protected location and preferably enclosed in another conduit 45 affixed to nozzle 29.

In addition, fuel tank adaptor 36 of U.S. Pat. No. 4,441,533 is modified to accept transmitting antenna 80 by having a threaded bore 81 formed through flange 89 such that transmitting antenna 80 may be threadingly engaged therein. Threaded bore 81 has its center line 79 displaced from datum line 90 by the aforementioned distance "d" substantially equal to distance "S".

Tubular member 84, containing transmitting antenna 80, is formed from a length of tubular material, having a threaded exterior 93, not less than seven eighths of an inch in length and has an internal cylindrical portion 92 on one end 83 thereof. Tubular member 84 has an antenna disc in end 83 and terminates with a tightening nut 87 on the other end 94 thereof. Tightening nut 87 completely closes other end 94 but has a hole 86 approximately one eighth inch in diameter drilled through the center thereof for receiving one end of transmitting antenna lead 85 which has its central conductor attached to antenna disc 82 and its shield grounded to member 84. The ground conductor may be attached by spot welding, soldering, screwing or capturing the flared end between the threads of tightening nut 87 and member 84. Antenna disc 82 is located approximately one sixteenth inch from the one end 83 and inserted into a flat recess 141 of an insulating plug 140 and secured thereat and therein by completely filling tubular member 84 with electrical potting compound. The electrical potting compound not only seals antenna disc 82 from the fueling environment but also seals antenna lead 85 within hole 86. Antenna lead 85 is then routed through an electrical conduit which is fixed to the locomotive. The one conductor having its end attached to antenna disc 82 is then attached to the antenna terminal 132 while the shield is attached to the antenna ground terminal 131, both terminals being readily accessible within or upon onboard locomotive information transmitter 130.

An alternate tubular member 84', containing transmitting antenna 80', is formed from a length of tubular material, having a threaded exterior 93', not less than seven eighths of an inch in length and has an internal cylindrical portion 92' on one end 83' thereof. Tubular member 84' has an antenna disc in end 83' secured therein by screw 146 and terminates with a tightening nut 87' on the other end 94' thereof. Tightening nut 87' forces seal plug 147 into intimate contact with and thereby completely closing other end 94' but has a hole 86' through the center thereof for receiving the projection on one end of seal plug 47 which contains one end of transmitting antenna lead 85' therein. Transmitting antenna lead 85' has its central conductor attached to the free end of screw 146 which extends through antenna disc 82' and insulating plug 140' and has its shield grounded to member 84'. The ground conductor may be attached by spot welding, soldering screwing or capturing the flared end between the threads of tightening nut 87' and member 84'. Antenna disc 82' is located approximately one sixteenth inch from the one end 83' and retained in a flat recess 141' of insulating plug 140' and is sealed therein by completely filling recess 141' with electrical potting compound. Tubular member 84' may further be filled with electrical potting compound at assembly of antenna 80'. The electrical potting compound not only seals antenna disc 82' from the fueling environment but also seals antenna lead 85' within hole 86'. Antenna lead 85' is then routed through an electrical conduit which is fixed to the locomotive. The one conductor having its end attached to antenna disc 82' is then attached to the antenna terminal 132 while the shield is attached to the antenna ground terminal 131, both terminals being readily accessible within or upon onboard locomotive information transmitter 130. Preferably, plugs 140, 140' are sealingly press fitted into ends 83, 83'.

It can readily be seen that upon removal of member 84 or 84' from threaded bore 81, line of sight between said transmitting antenna 80 or 80' and said receiving antenna 100 is broken thereby causing interruption of the fueling operation. Furthermore, since tubular member 84 or 84' is greater in length than the maximum withdrawal distance, removal of transmitting antenna 80 or 80' from threaded bore 81 also causes termination of the fueling operation.

Fueling crane 20 is fitted with receiving antenna lead 47 by routing same through a terminal coupling 60 on flexible hose 28 and passing antenna lead 47 through the fluid passage of both one pipe 21 and other pipe 22 and the swivel joint 23 connecting these two pipes together. When so routed, antenna lead 47 is encased in a fuel resistant thermoplastic sheath which is sealing engaged to an opening port in terminal coupling 60 of hose 28 and to an opening in "D" shaped horizontal swivel joint 24 or vertically disposed swivel joint 25 near or adjacent to interface terminal 110. The ends of antenna lead 47 are then secured to incoming antenna terminal and ground terminals respectively within interface terminal 110.

Each on board locomotive information transmitter 130 is preprogrammed with pertinent vehicle information and may further have real time capabilities for items such as engine hours and fuel level thereby providing the owner with a complete maintenance record of the locomotive. Data in the on board locomotive transmitter 130 is sent in a data string in binary code with stop bits between each event. When fueling nozzle 29 is inserted into fuel tank adaptor 36, a continuous string of coded information is transmitted in continuously repeating form from on board locomotive transmitter 130 through antenna lead 85 to transmitting antenna 80. The data information string then is transmitted through the air space across distance "R" and is received in receiving antenna 100. Through the electrical connections, the data string is received in interface terminal 110 for authorization of the fueling operation. Upon removal of nozzle 29 from adaptor 36, a fueling operation is terminated.

Alternately, an antenna connection conduit may be routed inside inner bore 40 of discharge end 35 in a manner similar to the vent tube of aforementioned U.S. Pat. No. 4,441,533. In this alternate embodiment, one end 43 of an antenna connection conduit 41 which houses antenna wire 42 is sealingly affixed to the inner bore 40 of discharge end 35 immediately under antenna 100. The other end 44 of antenna connection conduit 41 is also sealing affixed to inner bore 40 at a distance "Y" upstream of datum line 90 such that antenna wire 42 may be exteriorly attached to fueling nozzle 29 and thence routed along or inside of flexible hose 28 and fueling crane 20 to interface unit 110. In this alternative embodiment, hole 114 in receiving antenna 100 is aligned over the one end 43 of antenna connection conduit 41 to receive antenna wire 42 therein for securing to attachment point 113 adjacent to hole 114. A hole is pierced through insulating sleeve 102 through hole 114 in receiving antenna 100 directly over one end 43 of antenna connection conduit 41. Antenna wire 42 is then threaded through antenna conduit 41 with an end of one conductor being secured by a screw placed through screw hole 116 to attachment point 113. Thereafter, hole 114 and recess 115 of attachment point 113 are filled with an electrical potting compound to fully isolate attachment point 113 from any contact with fuel, vapor or metal. The other end of antenna wire 42 terminates in a standard RCA jack 98 for connection with antenna lead 47 in a manner well known in the art. Since receiving antenna 100 completely encircles discharge end 35, transmission of the digital data string at any circumferential engagement of the fueling nozzle 29 within the adaptor 36 is established and fueling operations may begin upon proper authorization from interface terminal 110. Similarly, even at any circumferential attitude of the fueling nozzle 29, fueling operations will be terminated upon withdrawal of fueling nozzle 29 by a distance greater than maximum withdrawal distance.

Alternate receiving antenna 100 may comprise at least one turn of wire wrapped around insulating sleeve 102 with one end attached to antenna lead 47. Flat, round or oval shaped wire may be utilized and the inside diameter of the wire coil may be made slightly smaller than the outside diameter of insulating sleeve 102 such that the wire may grip tightly about insulating sleeve 102 when installed thereon. Upon affixing antenna lead 47 to one end of the wire, the remaining space in insulating sleeve 102 may be filled with an electrical potting compound sealing the connection and antenna from the fueling environment. Multiple turns of fine wire may also be helically wound around insulating sleeve 102 and having an end attached to antenna lead 47 as above. The assembly may then be encased in electrical potting compound.

Although the invention has been described to permit secure fueling from a fueling facility to an authorized user through the novel transmitting antenna 80 and receiving antenna 100, the functions of these two antennae could be reversed for use at the fuel unloading stations 50. In this manner, transmitting antenna 80 becomes a receiving antenna affixed to a flange on the receiving port of fuel unloading stations 50 and receiving antenna 100 becomes a transmitting antenna on board the fueling tank car or truck transport. The function of the fueling operation remains the same as with the fueling cranes 70 permitting an unloading fuel carrier to provide fuel to the fueling facility 10 upon receipt of the proper authorizing data string. Similarly, the unloading operation would cease upon removal of the unloading nozzle from the adaptor, thereby preventing transfer of fuel to another vehicle after interruption of the authorizing data string.

While the forms and methods of this invention now preferred have been illustrated and described as required by the Patent Statute, it is to be understood that other forms and methods can be utilized and still fall within the scope of the appended claims.

We claim:

1. In a fueling nozzle having a rotatable locking ring adjacent its discharge end and being adapted for mating with and being secured to a fuel receiving tank adapter at a common datum line, said nozzle further having a receiving antenna associated therewith and said fuel receiving tank having a transmitting antenna associated therewith, said fueling nozzle activated by transmitted information transmitted as a continuous radio frequency signal from a continuously operating identity transmitter mounted on a vehicle desiring fueling, said identity transmitter powered by the vehicle power source and requiring no special activation by the user, the improvement wherein said receiving antenna comprises a circumferential band completely encircling said nozzle, is insulated therefrom and secured thereabout, and is in such close proximity with said transmitting antenna as to interrupt transmission of said information and to cause cessation of said fueling operation upon withdrawal of said fueling nozzle from said fuel tank more than a maximum functional distance.

2. A fueling nozzle as in claim 1 wherein said transmitting antenna is mounted in one location within a portion of said fuel receiving tank adaptor at a predetermined distance from a common datum line and contains a flat disc disposed in one end thereof.

3. A fueling nozzle as in claim 2 wherein said disc is disposed in a recess of an insulating plug press fitted into an internal cylindrical portion of a tubular member of said transmitting antenna mounted in said one location.

4. A fueling nozzle as in claim 3 wherein said tubular member is threadingly engaged in a threaded bore through said flange of said fuel tank adaptor.

5. A fueling nozzle as in claim 4 wherein said tubular member is disposed into said flange a distance greater than said functional distance thereby preventing removal of said tubular member during a fueling operation without interrupting the fueling operation.

6. A fueling nozzle as in claim 3 wherein an outer edge of said insulating plug is flush with an end of said tubular member.

7. A fueling nozzle as in claim 6 wherein said tubular member is disposed into a bore at said one location to a depth such that said end is just flush with an inner bore of said fuel tank adaptor to prevent damage to said disc during the insertion of a discharge end of said fuel nozzle.

8. A fueling nozzle as described in claim 6 wherein said receiving antenna and said transmitting antenna are substantially aligned when said fueling nozzle is releasably attached to said fueling adaptor.

9. A fueling nozzle as described in claim 8 wherein said maximum functional distance is established when an outboard edge of said receiving antenna is nearing an outer diameter of said end of said tubular member.

10. A fueling nozzle as described in claim 9 wherein said maximum functional distance is substantially equal to one half the width of said receiving antenna and one half the diameter of said end.

11. A fueling nozzle as described in claim 10 wherein said maximum functional distance is seven eighths inch.

12. A fueling nozzle as described in claim 2 wherein said flat disc is a metallic material.

13. In an improved fueling system for moving a supply of liquid through an automatic nozzle for dispensing a liquid into a container, said nozzle including a valve means, means including an operating lever for opening said valve means, pivotally mounted latch means, vacuum responsive means including a reciprocable member, trip means including a pivotally mounted lever connected to said reciprocable member and pivotally mounted concentrically with said latch means for engaging said latch means upon movement of said vacuum responsive means, means for biasing said latch means into automatic latching engagement with said operating lever upon actuation thereof to an open position, and means including conduit means for creating and supplying a vacuum to said vacuum responsive means for actuating said reciprocable member to trip and release said valve means when the liquid in said container reaches a preselected level, a fill pipe connected to said container, and a hollow adaptor for receiving the nozzle, said nozzle spout having separate liquid dispensing and air removal passages, said air removal passage being connected at one end to said vacuum responsive means, said fill pipe adaptor having first end and a second end, said first end being attached to said filler pipe and said second end extending into said filler pipe, said second end having a reduced diameter, and a frusto-conical section between said first end and said second end, an air conduit connected to said first end of said fill pipe adaptor and to the interior of said container to remove air from said container to the interior of said fill pipe adaptor, a vacuum chamber between said nozzle spout and said fill pipe adaptor when said nozzle spout is inserted in said fill pipe adaptor, the length of said nozzle spout being of a length to extend into said frustoconical section and to provide a narrow space between the end of the nozzle spout and the wall of the frustoconical section, whereby the velocity of the liquid flowing out of the nozzle spout draws air through said narrow space between the end of said nozzle spout and the wall of said frusto-conical section to create a partial vacuum in said vacuum chamber to supply vacuum to said vacuum responsive means, the improvement wherein said nozzle further has a receiving antenna associated therewith and said container has a transmitting antenna associated therewith, said fueling nozzle activated by transmitted information transmitted as a continuous radio frequency signal from a continuously operating identity transmitter mounted on a vehicle desiring fueling, said identity transmitter powered by the vehicle power source and requiring no special activation by the user wherein said receiving antenna comprises a circumferential band completely encircling said nozzle, is insulated therefrom and secured thereabout.

14. A fueling nozzle as described in claim 13 wherein said receiving antenna is in such close proximity with said transmitting antenna as to interrupt transmission of said information and to cause cessation of said fueling operation upon minimal withdrawal of said fueling nozzle from said container.

15. A fueling nozzle as described in claim 14 said transmitting antenna is spaced from said receiving antenna by a radial distance less than a maximum functional distance.

16. A fueling nozzle as described in claim 15 wherein said maximum functional distance is seven eighths inch.

17. In a fueling nozzle having a rotatable locking ring adjacent its discharge end and being adapted for mating with and being secured to a fuel receiving tank adapter at a common datum line, said nozzle further having a receiving antenna associated therewith and said fuel receiving tank having a transmitting antenna associated therewith, said fueling nozzle activated by transmitted information transmitted as a continuous radio frequency signal from a continuously operating identity transmitter mounted on a vehicle desiring fueling, said identity transmitter powered by the vehicle power source and requiring no special activation by the user, the improvement wherein said receiving antenna comprises a circumferential band completely encircling said nozzle, is insulated therefrom and secured thereabout, and is in such close proximity with said transmitting antenna as to prevent cross talking with any other transmitter.

18. A fueling nozzle as described in claim 17 wherein said transmitting antenna is spaced from said receiving antenna by a radial distance less than a maximum functional distance.

19. A fueling nozzle as described in claim 18 wherein said radial distance between said transmitting antenna and said receiving antenna is approximately one quarter inch.

* * * * *